US005346320A

United States Patent [19]

Nguyen

[11] Patent Number: 5,346,320

[45] Date of Patent: Sep. 13, 1994

[54] PRINTER CARRIAGE BUSHING

[75] Inventor: Michael A. Nguyen, Singapore, Singapore

[73] Assignee: Hewlett-Packard Company, Palo Alto, Calif.

[21] Appl. No.: 965,480

[22] Filed: Oct. 23, 1992

[51] Int. Cl.[5] ..... B41J 11/22

[52] U.S. Cl. ..... 400/354; 400/352

[58] Field of Search ..... 400/320, 354, 354.1, 400/354.3, 352; 403/13, 26, 157, 158; 384/265, 273, 276, 282

[56] References Cited

U.S. PATENT DOCUMENTS

| | | | |
|---|---|---|---|
| 674,625 | 5/1901 | Clay | 384/273 |
| 4,468,144 | 8/1984 | McMahon et al. | 400/354 |
| 4,620,805 | 11/1986 | Belanger | 384/276 |
| 4,772,899 | 9/1988 | Mamiya et al. | 400/354 |
| 4,898,487 | 2/1990 | Brull et al. | 400/354 |

*Primary Examiner*—Edgar S. Burr

*Assistant Examiner*—Ren Yan

*Attorney, Agent, or Firm*—David S. Romney

[57] ABSTRACT

A dimensionally stable bushing assembly for a printer carriage 10 uses a bushing liner 20 constructed of a relatively flexible and dimensionally non-stable lubricous material which is afforded dimensional stability by an interference fit of the exterior wall of the liner 20 with the interior wall 15, 17 of apertures 14, 16 in the carriage which are manufactured to the desired degree of dimensional tolerance. In the preferred embodiment, the printer carriage 10 is made of polycarbonate which slides on stainless steel slider rods. The bushing liners are preferably a molded mixture of from 25–35 percent carbon, 15–25 percent teflon and 45–55 percent nylon. Although such mixtures typically shrink during the molding process, it is necessary, due to the special open or C-shaped configuration of the liners, only to maintain a close control on the thickness of the molded liners 20 rather than carefully controlling both thickness as well as their peripheral dimension.

8 Claims, 1 Drawing Sheet

PRINTER CARRIAGE BUSHING

BACKGROUND OF THE INVENTION AND PRIOR ART

The present invention relates to a bushing system for a computer driven printer/plotter carriage which slides back and forth transversely of the path of paper travel through the printer/plotter on smooth support rods which are ordinarily cylindrical.

Bushing systems that require high tolerance and low friction have inherently conflicting design requirements since high tolerance bushing systems require dimensionally stable materials which usually have high friction properties. Conversely, a bushing system which is constructed primarily of lubricous material for reduced friction tends to be dimensionally unstable. Low friction bushings can be manufactured to the required tolerances by secondary machining operations with repeated inspections and rejection of bushings that are not manufactured to the correct tolerance. Clearly, such operations materially increase the per part finished cost.

A low friction bushing system which can be manufactured to and retain close tolerances is therefore required for printer/plotter carriages which must move without impediment at a high rate of speed with frequent reversals in the direction of movement along the slider rods.

SUMMARY OF THE INVENTION

The present invention provides a bushing assembly for a printer carriage supportable for movement along one or more parallel slider rods, said assembly comprising a bushing housing having a dimensionally stable inner wall and a bushing liner having a bearing surface and an outer wall, said liner being constructed of lubricous material which is dimensionally less stable than said housing inner wall, said liner being slidably mounted in said inner wall, said inner wall confining said outer wall of said liner to prevent said bearing surface from exceeding a desired tolerance with a slider rod on which said liner rides during operation of said printer carriage.

DESCRIPTION OF THE PREFERRED EMBODIMENT

Figures 1A, 1B, 2:
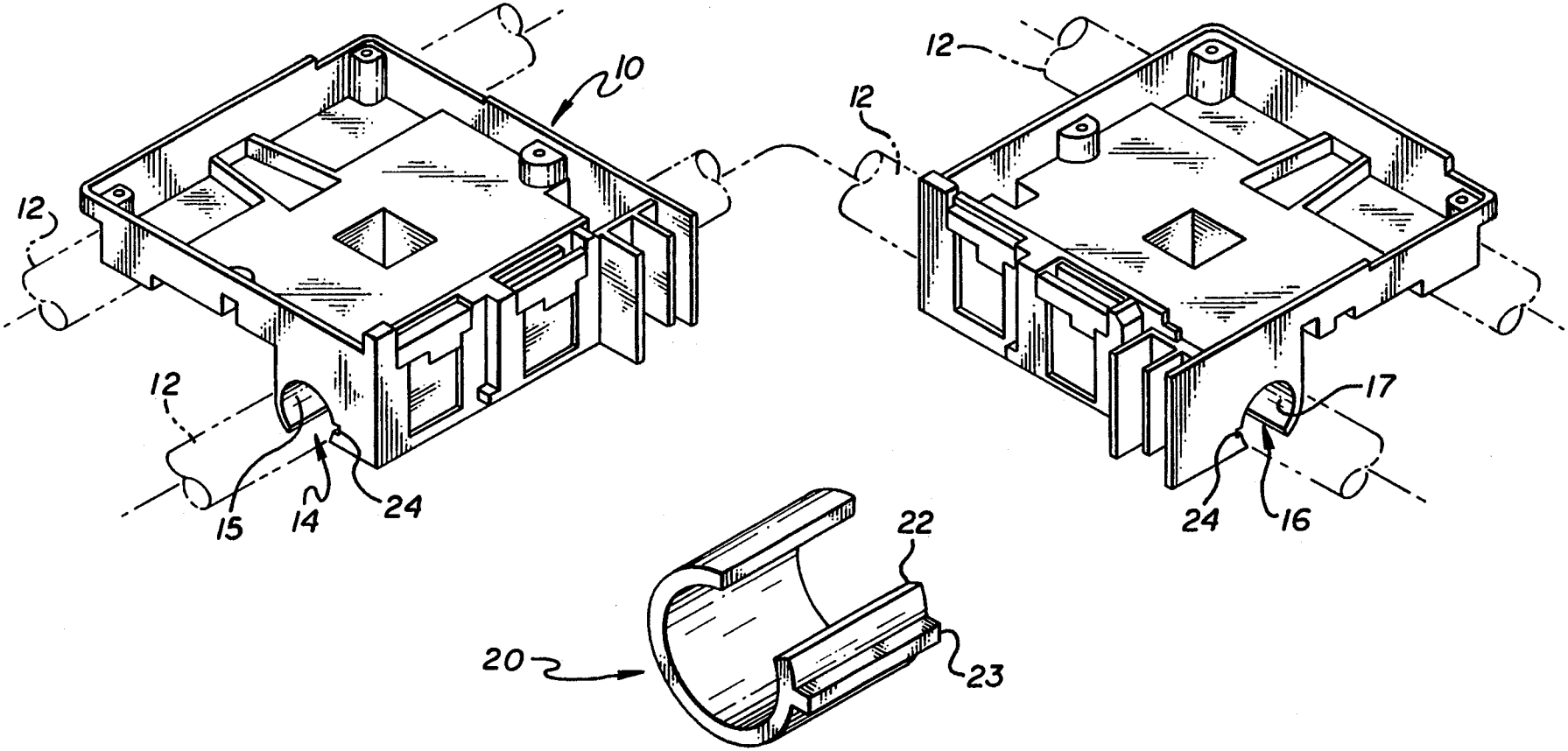
FIGS. 1A and 1B are perspective views of a printer/-plotter carriage mountable for sliding movement on a pair of slider rods shown in phantom.
FIG. 2 is a perspective view of a bushing liner which is received in a plurality of locations, preferably three, in the printer/plotter carriage of FIGS. 1 and 2.

As seen in FIGS. 1 and 2, the printer carriage 10 is a generally rectangular frame fabricated of metal and/or polycarbonates, and is mountable for sliding movement on a plurality of slider rods 12 shown in phantom which extend transversely of the path of movement of the paper or other printing medium through the printer. In the embodiment shown, the carriage is supported on the slider rods by two front bushings in apertures 14, 16 and a single rear bushing in a similar aperture (not shown) in the carriage 10. Each bushing assembly includes a housing, which may be the carriage aperture 14, 16 itself, or a separate dimensionally stable housing (not shown) mounted in the apertures in the carriage, and a bushing liner 20. The bushing liners 20 are made of lubricous materials. Our presently preferred liners are formed from a molded mixture of about 25–35% carbon, 15–25% teflon and 45–55% nylon. Since such mixtures typically shrink during the molding process, the final dimensions in the radial direction can be closely controlled by forming the liners 20 with an axially extending gap 22 to result in an open configuration such as a C-shape so that shrinkage takes place primarily circumfrentially rather than radially. Accordingly, little shrinkage of the thickness of the liners 20 takes place during molding. The molded C-shaped liners 20 are slightly flexible so that they can be compressed and slid axially into the receiving apertures 14, 16 or separate dimensionally stable housings in the carriage.

Since the carriage 10 is made of metal and/or polycarbonates, it is referred to herein as "dimensionally stable" as compared with the relatively flexible and less dimensionally stable bushing liners 20. The inner walls 15, 17 of the carriage apertures (or separate dimensionally stable housings, if used) may also be C-shaped and have a carefully controlled radius or radial dimensions to confine the outer walls of the liners 20 to prevent radial expansion thereof as the carriage 10 moves along the slider rods 12 thus maintaining close sliding clearance or dimensional tolerance between the liners 20 and slider rods 12.

An axially extending exterior rib or shoulder 22 is provided on the bushing liners 20 which is received in an axially extending slot 24 in the carriage apertures 14, 16 or housings to prevent rotation of the liners 20 relative to the carriage 10. It will of course be understood that although the liners are depicted as generally C-shaped with arcuate exterior and interior surfaces, other configurations could be used, e.g. a hexagonal liner received in a hexagonal aperture in the printer carriage. Construction of the liner 20 with an open shape such as a C-shape facilitates insertion of the liners 20 into the carriage apertures 14, 16 or housings and the inherent resiliency of the liners 20 results in a tight interference fit with the interior walls 15, 17 of the apertures or bearing housings.

Persons skilled in the art will readily appreciate that various modifications can be made from the preferred embodiment thus the scope of protection is intended to be defined only by the limitations of the appended claims.

I claim:

1. A bushing assembly for a printer carriage supportable in a radial direction for movement along one or more parallel slider rods, said assembly comprising:

a rigid bushing housing having a dimensionally stable inner wall which terminates in a lower slot;

a resilient molded bushing liner having a C-shaped bearing surface and an outer wall, wherein said inner wall of said housing and said outer wall of said liner are C-shaped, said liner having an axially extending gap therein whereby said liner may be compressed and is slideable into said housing along the direction of movement of said carriage, said molded liner comprising a mixture of self-lubricating materials which shrinks during the molding process and which is dimensionally less stable than said housing inner wall, said liner being slidably mounted in said inner wall so that said lower slot of said bushing housing and said gap of said liner both face downwardly after mounting on the one or more slider rods;

wherein said inner wall confines said outer wall of said liner to hold said liner in a predetermined position without any additional adjustment in the radial direction, said inner wall preventing said bearing surface from exceeding a desired tolerance with a slider rod on which said liner rides during operation of said printer carriage; and said outer wall further including a stop member for engaging said inner wall to prevent rotation of said liner relative to said housing.

2. The bushing assembly of claim 1, wherein said housing is polycarbonate.

3. The bushing assembly of claim 2, wherein said liner is a molded mixture of carbon, nylon and teflon.

4. The bushing assembly of claim 3, wherein said liner is from 25–35% carbon, 15–25% teflon and 45–55% nylon.

5. A printer carriage supportable in a radial direction for axial movement on a plurality of slider rods, comprising:

a plurality of rigid bushing housings each having a dimensionally stable C-shaped inner wall which terminates in a lower slot;

a plurality of resilient molded bushing liners each having a bearing surface and an outer wall which are both C-shaped, said liner having an axially extending gap therein whereby said liner may be compressed and is slideable into said housing along the direction of movement of said carriage, said molded liners each comprising a mixture of self-lubricating materials which shrinks during the molding process and which is dimensionally less stable than said housing inner walls, said liners being slidably mounted in said inner walls so that said lower slot of said bushing housings and said gap of said liners both face downwardly after mounting on the slider rods;

wherein said inner walls confine said outer walls of said liners to hold said liners in a predetermined position without any additional adjustment in the radial direction, said inner walls preventing said bearing surfaces from exceeding a desired sliding clearance with said slider rods; and said outer walls further including a stop member for engaging said inner wall to prevent rotation of said liners relative to said housings.

6. The printer carriage of claim 5, wherein said carriage is constructed of polycarbonate.

7. The printer carriage of claim 6, wherein said liners are constructed of a molded mixture of carbon, nylon and teflon.

8. The printer carriage of claim 7, wherein said liners are from 25–35% carbon, 15–25% teflon and 45–55% nylon.

* * * * *